US006769449B2

(12) United States Patent
Stearns

(10) Patent No.: US 6,769,449 B2
(45) Date of Patent: Aug. 3, 2004

(54) WATER BOOSTER METHODS AND APPARATUS

(76) Inventor: Kenneth W. Stearns, P.O. Box 55912, Houston, TX (US) 77055

( * ) Notice: Subject to any disclaimer, the term of this patent is extended or adjusted under 35 U.S.C. 154(b) by 179 days.

(21) Appl. No.: 10/209,854

(22) Filed: May 29, 2001

(65) Prior Publication Data

US 2003/0031553 A1 Feb. 13, 2003

Related U.S. Application Data

(63) Continuation of application No. 09/407,201, filed on Sep. 28, 1999, now Pat. No. 6,238,178.

(51) Int. Cl.[7] ..... F01D 15/00

(52) U.S. Cl. ..... 137/99; 137/565.33; 415/1; 415/26; 415/29; 415/147; 415/151; 415/156; 239/381; 239/396; 239/527; 417/53; 417/225; 417/234; 417/441

(58) Field of Search ..... 415/1, 26, 29, 415/47, 49, 50, 146, 151, 156, 157, 147, 202; 137/99, 565.33; 239/380, 381, 390, 396, 525–527; 417/53, 225, 234, 441; 418/7

(56) References Cited

U.S. PATENT DOCUMENTS

| | | | | | |
|---|---|---|---|---|---|
| 1,981,623 | A | * | 11/1934 | Karter | 422/269 |
| 2,449,002 | A | * | 9/1948 | Moody | 415/155 |
| 2,546,240 | A | * | 3/1951 | Squiers | 418/270 |
| 2,940,260 | A | * | 6/1960 | Mylcraine | 417/225 |
| 3,015,281 | A | * | 1/1962 | Umholtz | 417/234 |
| 3,801,224 | A | * | 4/1974 | Eberhardt | 137/527.8 |
| 4,754,770 | A | * | 7/1988 | Fornasari | 137/625.44 |
| 5,249,923 | A | * | 10/1993 | Negus | 415/202 |
| 5,622,480 | A | * | 4/1997 | Walsh | 417/234 |
| 5,988,600 | A | * | 11/1999 | Vento | 261/29 |
| 6,238,178 | B1 | * | 5/2001 | Stearne | 415/1 |

FOREIGN PATENT DOCUMENTS

GB 2166650 A * 5/1986

* cited by examiner

*Primary Examiner*—Christopher Verdier

(57) ABSTRACT

Water is first caused to flow through a first passage and rotate a first impeller. Rotation of the first impeller is linked to rotation of a second impeller, which is in fluid communication with a second, discrete passage. Vanes on the second impeller are constrained to move faster than vanes on the first impeller. Water is subsequently caused to flow through the second passage and to be more aggressively advanced by the second impeller.

7 Claims, 1 Drawing Sheet

WATER BOOSTER METHODS AND APPARATUS

CROSS-REFERENCE TO RELATED APPLICATIONS

Figure 1:
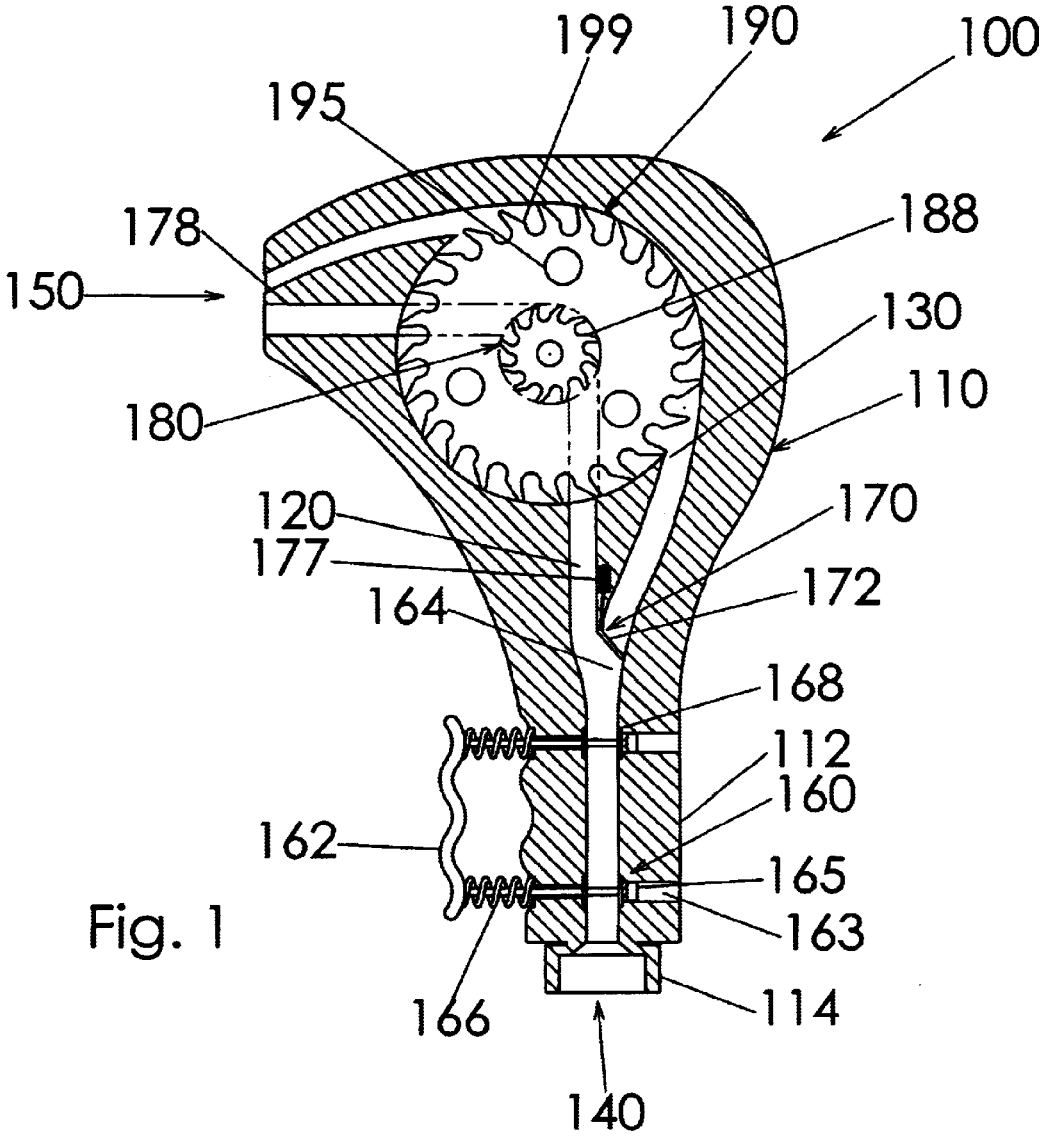

This application is a continuation of U.S. patent application Ser. No. 09/407,201, filed on Sep. 28, 1999 (now U.S. Pat. No. 6,238,178)

FIELD OF THE INVENTION

The present invention relates to methods and apparatus for intermittently boosting the amount of work performed by a given amount of water supplied at a given pressure.

BACKGROUND OF THE INVENTION

Those skilled in the art recognize the desirability of supplying water at relatively high pressure and/or speed. Among other things, many commonplace tasks are rendered easier by water being sprayed at relatively high pressure. In recognition of this need, machines known as "pressure washers" have been designed and manufactured. Although such machines produce the desired effect, they are relatively expensive and bulky and thus, not well suited for the needs of the average consumer.

SUMMARY OF THE INVENTION

A preferred embodiment of the present invention switches water flow between first and second impellers to intermittently spray water at relative greater pressure. The resulting apparatus overcomes some of the disadvantages of pressure washers while performing a comparable function. Among other things, the apparatus is sized for grasping in a person's hand and relatively less complex in construction. Additional features of the present invention will become apparent to those skilled in the art from the more detailed description that follows.

BRIEF DESCRIPTION OF THE FIGURE OF THE DRAWING

With reference to the Figure of the Drawing, FIG. 1 is a partially sectioned side view of a water booster constructed according to the principles of the present invention.

DETAILED DESCRIPTION OF A PREFERRED EMBODIMENT

A preferred embodiment of the present invention is designated as 100 in FIG. 1. The apparatus 100 generally includes a base or housing 110; a first passage 120 extending through the housing 110; a second passage 130 extending through the housing 110; an inlet 140 on the housing 110 which joins both the first passage 120 and the second passage 130; an outlet 150 on the housing 110 which joins both the first passage 120 and the second passage 130; a manually operated valve 160 disposed on the housing 110 between the inlet 140 and the outlet 150; an automatic valve 170 disposed on the housing 110 between the inlet 140 and the outlet 150; a first impeller 180 in fluid communication with the first passage 120; and a second impeller 190 in fluid communication with the second passage 130.

The housing 110 includes a handle portion 112 which is sized and configured to be grasped in a person's hand. A female hose connector 114 is rotatably connected to the bottom of the handle portion 112 and is operable to place the water inlet 140 in fluid communication with a conventional garden hose. The inlet passage 140 extends into the handle portion 112 and encounters at least one manually operated valve 160.

The manually operated valve 160 includes a trigger 162 which as movably connected to the handle portion 112 by a pair of slats 164. Slat accommodating openings 163 extend transversely through the handle portion 112. Water sealant members 168 are provided at the junctures between the inlet passage 140 and the slat accommodating openings 163 in the handle portion 112. A separate helical coil spring 166 is disposed on each slat 164 between the trigger 162 and the handle portion 112. The springs 166 bias the trigger 162 away from the handle portion 112. An opposite, distal end 165 of each slat 164 is relatively larger in diameter and is movably retained inside a relatively larger diameter portion of a respective opening 163. The ends 165 cooperate with the end walls of the openings 163 to limit movement of the trigger 162 away from the handle portion 112. When the trigger 162 occupies the position shown in FIG. 1, the slats 164 effectively seal off the inlet passage 140 from the remainder of the apparatus 100. When the trigger 162 is moved toward the handle portion 112, holes in the slats 164 move into alignment with the inlet passage 140 and allow water to flow through the inlet passage 140.

The inlet passage 140 extends beyond the manually operated valve 160 and encounters the automatic valve 170. The automatic valve 170 includes a flap or gate 172 which pivots relative to the housing 110 (and the inlet passage 140). The flap 172 is movable between a first position (shown in FIG. 1), wherein the flap 172 seals off the second passage 130 and places the inlet passage 140 in fluid communication with the first passage 120, and a second position, wherein the flap 172 seals off the first passage 120 and places the inlet passage 140 in fluid communication with the second passage 130. At least one sensor 177 (a second sensor 178 is shown in FIG. 1) is placed in communication with the flow of water through the apparatus 100 and cooperates with a conventional actuator (not shown) to move the flap 172 between the two positions in a manner further described below. The actuator may be powered by battery, inertia associated with the flow of water, or any other suitable means.

The first passage 120 extends from the automatic valve 170 and encounters vanes 188 on the first impeller 180, before arriving at the outlet 150. The first impeller 180 is rotatably mounted on the housing 110, and the flow of water through the first passage 120 and against the vanes 188 causes the first impeller 180 to rotate.

The second impeller 190 is rotatably mounted on the housing 110 and connected to the first impeller 180 so that it also rotates as water flows through the first passage 120. On the apparatus 100, the two impellers 180 and 190 are integrally connected and thus, rotate at the same rotational velocity about a common axis. However, since the second impeller 190 has a relatively larger diameter, its circumferentially arranged vanes 199 move faster than the vanes 188 on the first impeller 180.

When the sensor 177 senses that water flow through the first passage 120 has reached a sufficiently high threshold level, the valve 170 automatically diverts subsequent water flow away from the first passage 120 and into the second passage 130. The relatively greater speed of the vanes 199 encourages the water to exit the outlet 150 with relatively greater speed and/or pressure (than that resulting from flow through the first passage 120 and/or that existing at the inlet 140). Weights 195 may be provided on one or both impellers

180 and 190 to increase the inertia of the assembly and thereby produce a flywheel effect. When the sensor 178 senses that water flow through the second passage 130 has reached a sufficiently low threshold level, the valve 170 automatically diverts subsequent water flow away from the second passage 130 and back into the first passage 120 to increase the rotational velocity of the impellers 180 and 190.

Those skilled in the art will recognize that the present invention is not limited to the specifics of the preferred embodiment 100. For example, the two impellers 180 and 190 may be separate members which are connected by a belt and/or gear assembly. In such an instance, the magnitude of the "boost" effect is a function of the drive ratio between the two impellers, as well as their relative diameters. Also, the present invention is not limited to the foregoing method of implementation. For example, the rotational impellers 180 and 190 may be replaced by a piston assembly. Recognizing that those skilled in the art will derive additional embodiments and/or improvements, the scope of the present invention is to be limited only to the extent of the following claims.

What is claimed is:

1. A method of boosting water pressure between an inlet and an outlet, comprising the steps of:

providing a housing having the inlet, the outlet, a handle portion, a first passage extending between the inlet and the outlet, a second passage extending between the inlet and the outlet, and an automatic valve;

holding the handle portion in hand;

channeling water through the first passage and storing energy associated with flow of water through the first passage; and diverting water through the second passage and using the energy to pressurize water flowing through the second passage in excess of water pressure at the inlet passage, wherein a sensor activates the automatic valve to perform the diverting step.

2. The method of claim 1, wherein a manually operated valve is provided on the housing, and the channeling step is performed by moving the manually operated valve.

3. The method of claim 1, further comprising the step of connecting the inlet to a garden hose.

4. A method of boosting water pressure between an inlet and an outlet, comprising the steps of;

providing a housing having the inlet, the outlet, a handle portion, a first passage extending between the inlet and the outlet, a second passage extending between the inlet and the outlet, and a manually operated valve movably mounted on the handle portion of the housing;

holding the handle portion in hand;

channeling water through the first passage and storing energy associated with flow of water through the first passage, wherein the channeling step is performed by squeezing a portion of the manually operated valve against the handle portion; and diverting water through the second passage and using the energy to pressurize water flowing through the second passage in excess of water pressure at the inlet passage.

5. A method of boosting water pressure between an inlet and an outlet, comprising the steps of:

providing a housing having the inlet, the outlet, a first passage extending between the inlet and the outlet, a second passage extending between the inlet and the outlet, and an automatic valve;

connecting the inlet to a garden hose;

channeling water through the first passage and storing energy associated with flow of water through the first passage; and diverting water through the second passage and using the energy to pressurize water flowing through the second passage in excess of water pressure at the inlet passage, wherein a sensor activates the automatic valve to perform the diverting step.

6. The method of claim 5, wherein a manually operated valve is provided on the housing, and the channeling step is performed by moving the manually operated valve.

7. A method of boosting water pressure between an inlet and an outlet, comprising the steps of:

providing a housing having the inlet, the outlet, a first passage extending between the inlet and the outlet, a second passage extending between the inlet and the outlet, a handle portion, and a manually operated valve movably mounted on the handle portion of the housing;

connecting the inlet to a garden hose;

channeling water through the first passage and storing energy associated with flow of water through the first passage, and the channeling step is performed by squeezing a portion of the manually operated valve against the handle portion; and diverting water through the second passage and using the energy to pressurize water flowing through the second passage in excess of water pressure at the inlet passage.

* * * * *